United States Patent [19]

Boyal

[11] Patent Number: 4,864,107

[45] Date of Patent: Sep. 5, 1989

[54] ELECTRICAL HEATING CABLE

[76] Inventor: Mohan S. Boyal, 49 Scott Avenue, Penn, Wolverhampton, England

[21] Appl. No.: 162,979

[22] Filed: Mar. 2, 1988

[51] Int. Cl.[4] ..... H05B 3/34

[52] U.S. Cl. ..... 219/549; 219/548; 219/546

[58] Field of Search ..... 219/549, 553, 535, 548, 219/546, 544

[56] References Cited

U.S. PATENT DOCUMENTS

| | | | |
|---|---|---|---|
| 4,117,312 | 9/1978 | Johnson et al. | 219/548 |
| 4,348,584 | 9/1982 | Gale et al. | 219/544 X |
| 4,547,655 | 10/1985 | Kurata et al. | 219/535 X |
| 4,574,188 | 3/1986 | Midgley et al. | 219/549 |
| 4,724,417 | 2/1988 | Au et al. | 219/549 X |
| 4,792,663 | 12/1988 | Kishimoto et al. | 219/549 |

*Primary Examiner*—E. A. Goldberg
*Assistant Examiner*—M. M. Lateef
*Attorney, Agent, or Firm*—Horst M. Kasper

[57] ABSTRACT

An electrical heating cable comprises two or more electrical conductors provided individually or collectively with a covering of electrical insulation material. The cable includes a heating element comprising a heating wire wrapped in a helical configuration about a core formed of a bundle of glass fibre filaments. The heating element is joined to alternate conductors by soldering or welding at intervals along the length of the cable. The element is mechanically independent of the conductors between the junction regions, the conductors and the element being held together by an outer sheath.

9 Claims, 2 Drawing Sheets

FIG. 3
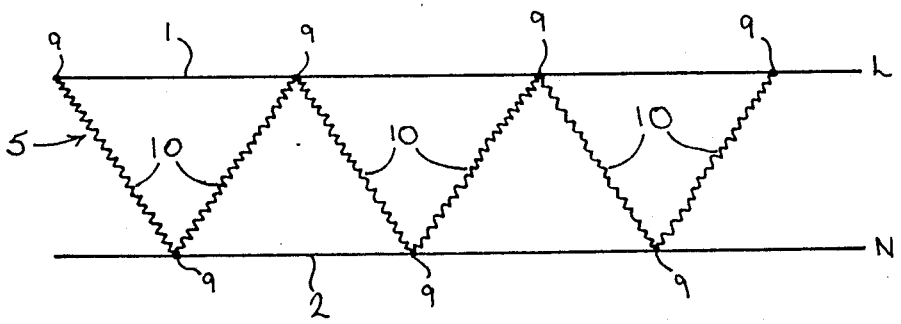
FIG. 4
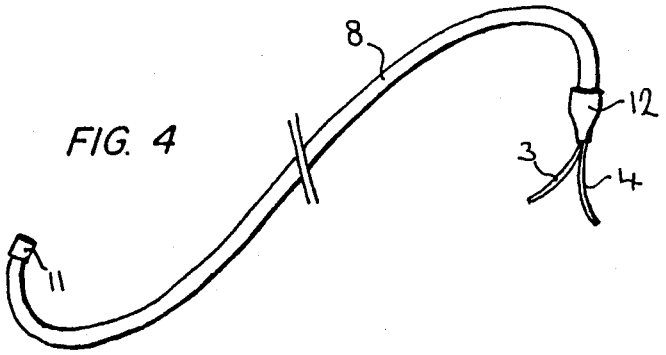
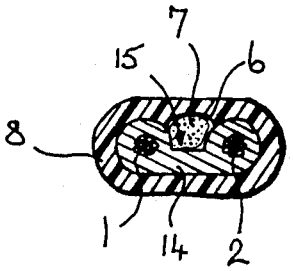
FIG. 5

ELECTRICAL HEATING CABLE

BACKGROUND OF THE INVENTION

A known form of electrical heating cable, e.g. from British Patent Specifications Nos. 2 098 438 A, 2 130 459 A and 2 138 660 A, comprises a pair of electrical conductors held separately or jointly in a core of electrical insulation material. A series of electrical heating wires are wrapped in a helical configuration or otherwise mechanically supported on the core and are connected in parallel across the conductors by contact with exposed portions of alternate conductors at spaced positions along the length of the cable. An outer insulating sheath is then applied over the core and heating wire. Since the heating wires must be wrapped around the core before the outer sheath is applied, this form of construction is very slow and expensive to manufacture without special machinery.

Although it is known to physically join the heating wire to the conductors e.g. by soldering, it is normally preferred for ease of manufacture to simply rely on pressure contact between the heating wire and the exposed conductor. Hence, in British Patent Specification No. 2 110 910 A it is proposed to use a heating element in the form of a heating wire wrapped around a bundle of glass fibre filaments, the whole heating element again being wrapped helically about an inner insulating core, to overcome the problem of loss of contact between the heating wire and the conductors when the wire expands. This form of construction is again relatively expensive to manufacture for the above-stated reason.

U.S. Pat. No. 4,117,312 again discloses a form of heating cable in which the heating wire is wrapped around an insulating core containing the conductors, and it also discloses a further form of construction in which a continuous strip heating element is deposited between a pair of conductors in continuous contact with them along the length of the cable. Continuation-in-part U.S. Pat. No. 4,072,848 discloses another arrangement in which discrete heating are arranged at spaced positions along the cable, each element being connected directly between the conductors on opposite sides of the element.

British Patent Specification No. 2 120 909 A discloses a form of cable which comprises two or more conductors, an inner insulating core, one or more heating wires and an outer sheath, but the conductors are not enclosed within the inner core. The conductors either run along opposite sides of the core and the heating wire is wrapped around the core and the conductors, or vice versa. In another illustrated embodiment the inner core is omitted altogether and a single heating wire zig-zags between the conductors These forms of cable are again difficult to manufacture without specialised machinery.

British Patent Specification No. 2 048 626 A discloses yet another form of heating cable in which a heating wire comprises a weft in a woven tape and the wire is periodically interwoven with two conductors running along opposite sides of the tape. An outer sheath is applied over the tape and the conductors but there is no inner insulating core surrounding the conductors. It is suggested that the woven tape could be replaced by a wire microhelix wound on a small diameter core but this postulated form of construction is not specified in further detail.

It is believed that the design of heating cables such as those described above has hitherto been constrained by the not unreasonable assumption that the heating element itself must be as close as possible to the external surface of the cable in order to provide a uniform heating effect from all surfaces of the cable and avoid possible local overheating of the heating element which could result in damage to the cable.

An object of the invention is to provide a form of heating cable which is quick and inexpensive to produce without requiring special machinery yet which is reliable and efficient in operation and has a good life expectancy.

SUMMARY OF THE INVENTION

According to the present invention, two or more current carriers are enclosed separately or jointly within an inner insulating sheath. A heating element running lengthwise of the cable is positively joined to alternate conductors at spaced positions along the length of the cable. The element is separate from and is not mechanically supported by the inner sheath in between the junction regions, and the sheath, conductors and heating element are simply held together by an outer sheath.

Contrary to what might be expected it has been found that despite the fact that the heating element is not equidistant from the outside of the cable, the cable rapidly attains a uniform working temperature throughout its cross sectional area.

The heating element preferably comprises a heating wire which is helically wound around an inner core, e.g. of glass fibre filaments.

BRIEF DESCRIPTION OF THE DRAWINGS

FIG. 5 is a cross-section through a modified form of cable.

DETAILED DESCRIPTION OF THE ILLUSTRATED EMBODIMENT

Figure 1:
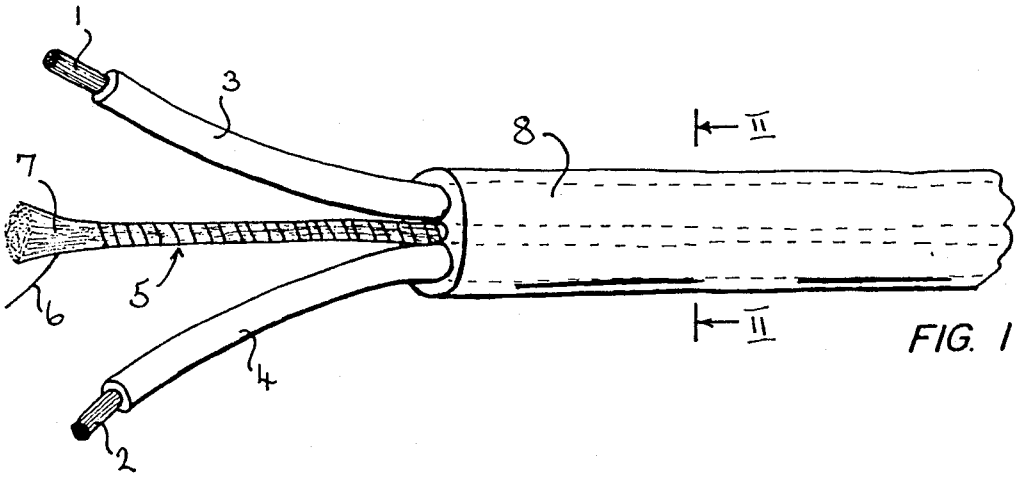
FIG. 1 perspective view of a portion of a heating cable in accordance with the invention, an end portion of the outer sheath having been removed to reveal the internal structure of the cable.
Figure 2:
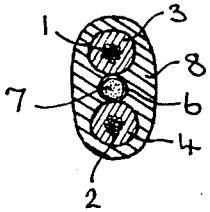
FIG. 2 is section II—II of FIG. 1, FIG. 3 electrical diagram of the cable, FIG. 4 an external view of the complete cable together with its end terminations.

Referring to FIGS. 1 and 2, the cable includes a pair of multi-wire copper current carrying conductors 1, 2 each provided with an electrically insulating silicone rubber covering 3, 4 respectively. The cable also includes an electrical heating element 5 comprising a resistance heating wire 6 helically wrapped around a heat-resistant core in the form of a bundle of glass fibre filaments 7. The element 5 runs in a linear path substantially equidistant between the two insulated conductors. The insulated conductors and the heating element are all enclosed by an outer silicone rubber sheath 8.

As shown in FIG. 3, the heating element 5 is connected to alternate conductors 1, 2 at junctions 9 which are spaced along the cable at substantially equal intervals, e.g. of 1 meter. This is achieved by removing a short portion of the covering 3, 4 of the appropriate conductor and either soldering or welding the heating wire 6 to the exposed conductor. The heating element could also be mechanically coupled to the respective conductor, e.g. by crimping a split collar about them. The heating wire is thus divided by the junctions 9 into heating lengths 10 which are connected in parallel between the conductors 1, 2.

The cable can be manufactured in a continuous length by feeding the conductors complete with their insulating coverings 3, 4 from respective drums, the heating element 5 being similarly fed from a further drum. A short portion of the insulating sheath is removed from one of the conductors and the appropriate connection is made with the end of the heating element. A portion of the insulation is then removed from the other conductor at an appropriate position along its length and the next connection with the heating element is made. This process is repeated at appropriate distances with the junctions alternating from one conductor to the other. The insulated conductors are fed together with the heating element to an extrusion machine which extrudes the outer sheath over them. Thus in the finished cable the lengths 10 are mechanically independent of and unsupported by the insulated conductors between the junction regions 9, the insulated conductors and the heating element being held together solely by the outer sheath 8.

Although the heating element 5 is not equidistant from all points on the external surface of the cable it is found in practice that the cable quickly attains an equilibrium temperature and appears to give out heat equally from all surfaces.

At one end of the cable the exposed conductors can be protected by a push-on or moulded end cap 11 (FIG. 4). At the other end the cable is sealed by a push-on, moulded or shrink-wrap sleeve 12 through which the conductors 1, 2 are brought complete with their insulation 3, 4 for connection to a.c. mains, LN.

The cable is very simple to produce without special machinery. No thermostat is required to protect against overheating of the cable and the silicone rubber sheath 8 provides considerable mechanical strength and resistance to most chemicals, oils, and weak acids and alkalis.

As shown in FIG. 5, the conductors 1, 2 could be carried in a single cover 14 instead of separate coverings as shown. The cover is of B-shaped cross section and includes a groove 15 in which the heating element nestles. The cover could alternatively be of figure-of-eight shape with two back-to back grooves, one of which receives the heating element. Within the scope of the invention more than two conductors could be provided, e.g. for a multiphase a.c. supply.

I claim:

1. An electrical heating cable comprising:

first and second current carriers running lengthwise of the cable, cover means enclosing the current carriers along substantially the length of the cable to electrically insulate the current carriers from one another, a heating element running lengthwise of the cable outside the said cover means, a plurality of junction regions disposed at spaced positions along the length of the cable at each of which the heating element is physically and electrically connected to one of the current carriers, the heating element being joined to different current carriers at successive junction regions, and the arrangement being such that the heating element is mechanically independent of and is not supported by or joined to the said cover means between the said junction regions, and a sheath of electrical insulation material which encloses the current carriers, the cover means, the heating element and the junction regions along the length of the cable.

2. A cable according to claim 1, in which the heating element comprises a heating wire and a heat-resistant core, the heating wire being wrapped around the said core in a helical configuration.

3. A cable according to claim 2, in which the said core comprises a bundle of glass fibre filaments.

4. A cable according to claim 1, in which the heating element is disposed substantially equidistant between the first and second current carriers.

5. A cable according to claim 1, in which the heating element is soldered to the respective current carrier at each junction region.

6. A cable according to claim 1, in which the heating element is welded to the respective current carrier at each junction region.

7. A cable according to claim 1, in which the first and second current carriers are enclosed within a common cover means and the heating element is disposed within a groove formed in the outer surface of the cover means between the two current carriers.

8. A cable according to claim 7, in which the common cover means is substantially of B-shaped cross section.

9. A method of producing an electrical heating cable, which comprises physically joining an electrical heating element to alternate electrically insulated conductors at spaced junction regions along their length, and extruding an outer sheath of electrical insulation material about the insulated conductors and the heating element such that the heating element is mechanically independent of and is not joined to or supported by the insulation material of the current carriers between the junction regions.

* * * * *